US007286094B2

(12) United States Patent
Ratni et al.

(10) Patent No.: US 7,286,094 B2
(45) Date of Patent: Oct. 23, 2007

(54) THREE-DIMENSIONAL OMNI-DIRECTIONAL ANTENNA DESIGNS FOR ULTRA-WIDEBAND APPLICATIONS

(75) Inventors: Mohamed Ratni, Esslingen (DE); Dragan Krupezevic, Stuttgart (DE)

(73) Assignee: Sony Deutschland GmbH, Cologne (DE)

( * ) Notice: Subject to any disclaimer, the term of this patent is extended or adjusted under 35 U.S.C. 154(b) by 146 days.

(21) Appl. No.: 11/007,949

(22) Filed: Dec. 9, 2004

(65) Prior Publication Data

US 2005/0156804 A1 Jul. 21, 2005

(30) Foreign Application Priority Data

Dec. 11, 2003 (EP) ..... 03028574

(51) Int. Cl.
*H01Q 13/00* (2006.01)

(52) U.S. Cl. ..... 343/773; 343/772

(58) Field of Classification Search ..... 343/700 MS, 343/754, 785, 846, 773, 702, 772
See application file for complete search history.

(56) References Cited

U.S. PATENT DOCUMENTS 2,454,766 A 11/1948 Brillouin ..... 250/33.63

(Continued)

FOREIGN PATENT DOCUMENTS

DE 1 466 400 4/1970

(Continued)

*Primary Examiner*—Douglas W. Owens
*Assistant Examiner*—Jimmy Vu

(74) *Attorney, Agent, or Firm*—Oblon, Spivak, McClelland, Maier & Neustadt, P.C.

(57) ABSTRACT

The present invention generally relates to the field of microwave antennas, and, more particularly, to a number of three-dimensional designs for the radiation element of an ultra-wideband monopole antenna with a symmetrical omni-directional radiation pattern operated in the frequency range between 3.1 GHz and 10.6 GHz. Said antenna is connected to the analog front-end circuitry of a wireless communication device used for transmitting and/or receiving microwave signals and meets the FCC requirements in terms of antenna gain, radiation pattern, polarization, frequency bandwidth, group delay, and size. It comprises a radiation element consisting of an air- and/or dielectric-filled cavity structure with a base plane and a radiator plane. A metallic ground plane having a relatively high surface impedance to electromagnetic waves within said frequency range, which is printed on a dielectric substrate, serves as a reflector. The monopole antenna further comprises an antenna feeding circuitry used for electronically steering the symmetrical omni-directional radiation pattern and a feeding line connecting the antenna feeding circuitry with the base plane of the radiation element. Thereby, parts of the analog front-end circuitry can optionally be placed within the air-filled part of the radiation element of the antenna.

The proposed designs include a radiation element having the form of a truncated right circular cone, rotational-symmetric radiation elements with a convexly- or concavely-shaped 3D surface, respectively, a radiation element in the form of a truncated right regular pyramid with a square base plane, and radiation elements with a combined structure comprising a conical, pyramidal, convexly- or concavely-shaped first part and a closed cylindrical or cuboidal second part whose top plane is arranged on top of the congruent base plane of said first part. Further embodiments include radiation elements with the form of a radially notched cylinder or hemisphere as well as combined structures consisting of at least two convexly-shaped elements or two conical parts, respectively, stacked on top of each other.

20 Claims, 6 Drawing Sheets

U.S. PATENT DOCUMENTS

| | | | | |
|---|---|---|---|---|
| 3,829,863 | A * | 8/1974 | Lipsky | 343/773 |
| 4,851,859 | A * | 7/1989 | Rappaport | 343/790 |
| 5,929,819 | A * | 7/1999 | Grinberg | 343/754 |
| 6,198,454 | B1 * | 3/2001 | Sharp et al. | 343/773 |
| 6,346,920 | B2 * | 2/2002 | Sharp et al. | 343/773 |
| 2002/0053994 | A1 | 5/2002 | McCorkle | 343/773 |
| 2002/0057222 | A1 * | 5/2002 | McKinzie et al. | 343/700 MS |

FOREIGN PATENT DOCUMENTS

| | | |
|---|---|---|
| EP | 0 766 343 | 4/1997 |

* cited by examiner

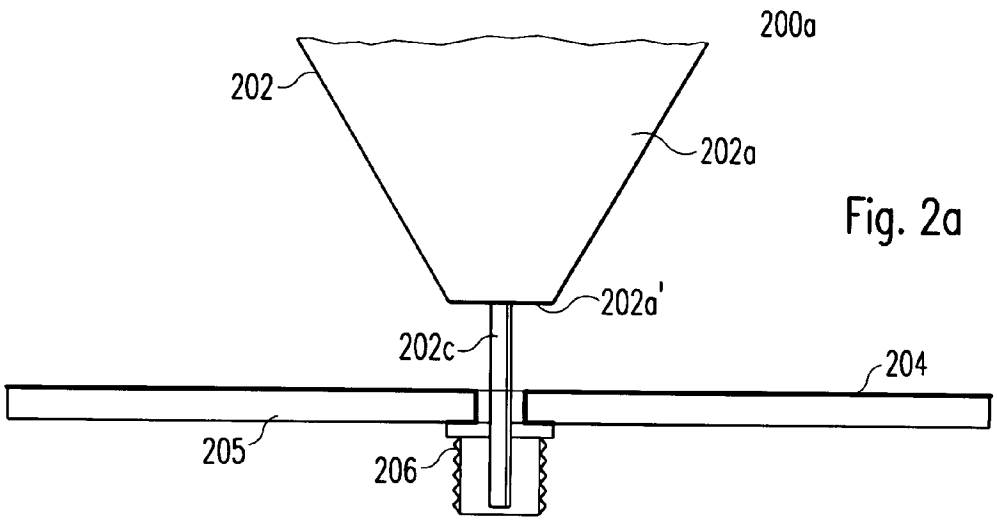
Fig. 2a
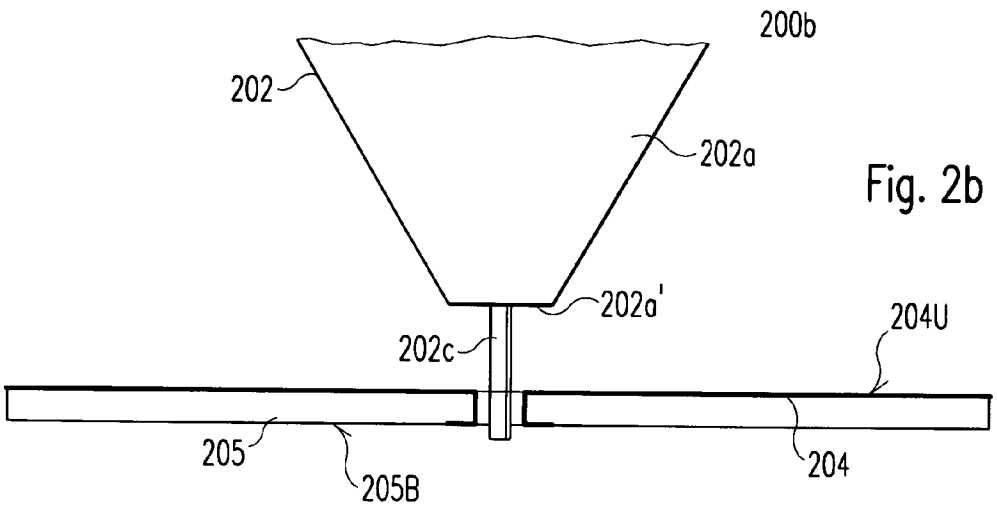
Fig. 2b
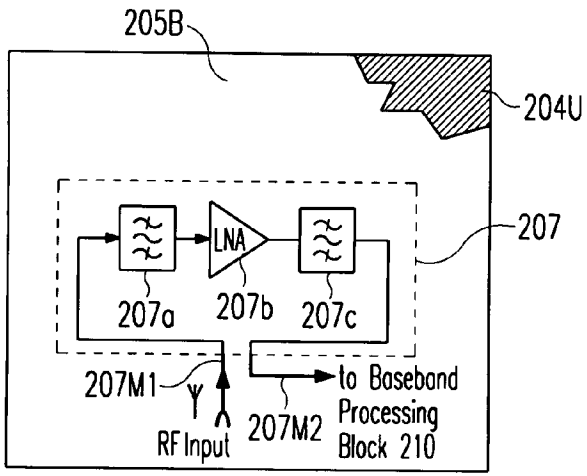

THREE-DIMENSIONAL OMNI-DIRECTIONAL ANTENNA DESIGNS FOR ULTRA-WIDEBAND APPLICATIONS

FIELD AND BACKGROUND OF THE INVENTION

The present invention generally relates to the field of microwave antennas, and more particularly, to three-dimensional designs for the radiation element of an ultra-wideband (UWB) monopole antenna with a symmetrical omni-directional radiation pattern for transmitting and/or receiving microwave signals.

UWB generally covers a frequency range between 3.1 GHz and 10.6 GHz. A FCC definition is given e.g. in IEEE 802.15 the disclosure of which is hereby incorporated by reference. According to the IEEE 802.15 Working Group for Wireless Personal Area Networks (see e.g. http://www.ieee802.org/15/) the 802.15 WPAN™ effort focuses on the development of Personal Area Networks or short distance wireless networks. These WPANs address wireless networking of portable and mobile computing devices such as PCs, Personal Digital Assistants (PDAs), peripherals, cell phones, pagers, and consumer electronics; allowing these devices to communicate and interoperate with one another.

The main issues concerning the design of microwave antennas usable for UWB are

- to have the capability of a simple planar feeding and a printed low-cost manufacturing,
- to achieve a significant cost reduction by simultaneously applying the core substrate of the RF front-end chip as a substrate for the antenna, which means that antenna prints could simultaneously be manufactured by using the layout procedure for classic RF front-end chip circuits, and
- to have the capability to cope with symmetrical omni-directional antenna patterns with gains of 0 to 1 dBi (type 1) and/or sector gains of around 6 dBi (type 2).

Recently, since emphasis has been laid on reducing size, providing increased power efficiency and meeting the requirements of the Federal Communications Commission (FCC) for mobile handset emissions, two additional elements of antenna design have risen in importance that must equally be considered along with conventional design parameters: the enhancement of antenna efficiency and control of the Specific Absorption Rate (SAR).

It is well known that the length of a microwave antenna is inversely proportional to the frequency of transmission: The smaller the antenna size, the lower the antenna efficiency and the narrower is the bandwidth. Thus, as new wireless applications move up in frequency, their antennas correspondingly decrease in size. This natural size reduction, however, is no longer sufficient to meet the demands of consumers. For this reason, antennas are more and more becoming customized components, unique to each wireless manufacturer's performance, size and cost requirements. This evolution is being driven by new radio applications and services which call for antennas that are able

- to achieve a higher gain, thereby allowing a reduction in transmitter battery power and a better reception in "dead spots",
- to allow multi-band operation by integrating PCS-based applications operating at 1,900 MHz, applications based on GPS and/or wireless data exchange applications into a single antenna,
- to support directional control over handset emissions by allowing more flexible antenna designs which can be used to control the direction of emissions in the vicinity of body tissue and to achieve a better signal reception, and finally
- to provide a wider channel bandwidth in order to satisfy the ever-increasing demands for high data rates.

Usually, microwave antennas are specified according to a set of parameters including operating frequency, gain, voltage standing wave ratio (VSWR), antenna input impedance and bandwidth. If the VSWR is greater than 3, for instance, a matching network has to be placed between the transmitter and its antenna to minimize mismatch loss, although a low VSWR is not a design necessity as long as the antenna is an efficient radiator. Said design is costly and makes an automation of the matching function much slower than designs applying low-power and solid-state tuning elements.

Ultra-wideband (UWB) technology, which was originally developed for ground-penetrating radar (GPR) applications, came into use as a result of researchers' efforts for detecting and locating surface-laid and shallow-buried targets, e.g. anti-personal landmines. With the development of RF electronics the initial desire to discriminate between two closely flying airplanes changed to the quest for constructing a three-dimensional image of a radar target. The potential for direct reduction of the incident pulse duration was soon exhausted and followed by a detailed analysis of target-reflected signals. It became clear that the most important changes in a target response occurred during a transient process with the duration of one or two oscillations. This fact in itself led to the idea of using UWB signals of this duration without energy expenditure for steady oscillation transmission.

Due to the evolution of wireless communications in the area of cellular telephony, wireless local area networks (WLANs) and wireless personal area networks (WPANs), particularly in the frequency range between 0.9 and 5 GHz, higher frequency bands and ultra-wideband wireless communication systems with minimal RF electronics, high data rate performance, low power consumption and a low probability of detection (LPD) signature are urgently needed. Today, UWB system are e.g. used as a wireless RF interface between mobile terminals (cell phones, laptops, PDAs, wireless cameras or MP3 players) with much higher data rates than Bluetooth or IEEE 802.11. A UWB system can further be used as an integrated system for automotive in-car services, e.g. for downloading driving directions from a PDA or laptop for use by a GPS-based on-board navigation system, as an entertainment system or any location-based system, e.g. for downloading audio or video data for passenger entertainment.

Ultra-wideband monopole antennas and modified monopoles are employed in a wide variety of applications today. Traditionally, mobile phones and wireless handsets are equipped with wideband and ultra-wideband monopole antennas. One of the most common $\lambda/4$ monopole antennas is the so-called whip antenna, which can operate at a range of frequencies and is capable of dealing with most environmental conditions better than other monopole antennas. However, a monopole antenna also involves a number of drawbacks. Monopole antennas are relatively large in size and protrude from the handset case in an awkward way. The problem with a monopole antenna's obstructive and space-demanding structure complicates any efforts taken to equip a handset with several antennas to enable multi-band operation.

There are a wide variety of methods being investigated to deal with the deficiencies of the common $\lambda/4$ monopole antenna, many of these methods being based on microstrip antenna designs. One such promising design is the Inverted-F Antenna (IFA), a distant derivative of the monopole antenna. The IFA utilizes a modified inverted-L low profile structure, which has frequently been used for aerospace applications. The common IFA comprises a rectangular radiation element with an omni-directional radiation pattern and exhibits a reasonably high antenna gain. The bandwidth of the IFA is broad enough for mobile operation, and the antenna is also highly sensitive to both vertically and horizontally polarized radio waves, thus making the IFA ideally suited to mobile applications. Since there is an increasing demand for antennas that can be operated at multiple frequency bands, cellular phone systems nowadays operate at a number of frequency bands (e.g. 900 MHz, 1.8 GHz, and 2.0 GHz).

BRIEF DESCRIPTION OF THE PRESENT STATE OF THE ART

According to the state of the art, different approaches have been pursued to meet advanced requirements of designing low-cost solutions for high-performance broadband microwave antennas with a reduced size and a significantly improved performance. These microwave antennas achieve higher gain, make multiple-band operation possible, allow directional control over electromagnetic emissions of mobile handsets, which leads to a higher antenna efficiency, and provide wider bandwidths to satisfy the ever-increasing demands for data rates of mobile applications. Since these requirements involve complex design problems, wireless device manufacturers are realizing that antenna solutions based on conventional technologies are no longer sufficient.

An apparatus for establishing a signal coupling between a signal supply and an UWB antenna comprising a first and a second radiating element for being operated in a frequency band between 2 and 6 GHz is disclosed in WO 02/093690 A1. The signal supply thereby delivers a signal to the antenna at a connection locus including one edge of the first radiating element and one edge of the second radiating element. The apparatus further comprises a first and a second feed structure. Said first feed structure extends a feed distance from the signal supply to said edge of the second radiating element and divides the first radiating element into two regions in spaced relation with the first feed structure to establish a tapered separation distance between the first feed structure and the two regions. Said second feed structure couples the signal supply with the first radiating element. The aforementioned separation distance thereby establishes a signal transmission structure between the two regions and the first feed structure.

The invention described in US 2002/0053994 A1 refers to a planar UWB antenna with an integrated electronic circuitry. The antenna comprises a first balance element which is connected to a terminal at one end. A second balance element is connected to another terminal at another end. Thereby, said second balance element has a shape which mirrors the shape of the first balance element such that there is a symmetry plane where any point on the symmetry plane is equidistant to all mirror points on the first and second balance element. Each of the balance elements is made of an essentially conductive material. A triangular-shaped ground element is situated between the first balance element and the second balance element with an axis of symmetry on the symmetry plane and oriented such that the base of the triangle is towards the terminals. Accordingly, the ground element and each of the balance elements form two tapered gaps which widen and converge at the apex of the ground element as the taper extends outwardly from the terminals. Under this arrangement, sensitive UWB electronics can be housed within the perimeter of the ground element, thereby eliminating transmission line losses and dispersion. A resistive loop connected between the first and second balance element extends the low frequency response and improves the voltage standing wave ratio. A connection of a linear array of elements is disclosed that provides a low-frequency cutoff defined by the array size and limits its radiation pattern to one direction with a radiation angle of maximal 180 degrees in azimuth.

OBJECT OF THE UNDERLYING INVENTION

In view of the explanations mentioned above, it is the object of the invention to propose a design for an ultra-wideband antenna (frequency range between 3.1 GHz and 10.6 GHz) that fulfill the UWB standard specifications and meet the FCC requirements in terms of antenna gain, radiation pattern, polarization, frequency bandwidth, group delay, and small size.

This object is achieved by means of the features of the independent claims. Advantageous features are defined in the subordinate claims.

SUMMARY OF THE INVENTION

The present invention is basically dedicated to a number of three-dimensional designs for the radiation element of a monopole antenna with a symmetrical omni-directional radiation pattern for transmitting and/or receiving microwave signals within a predetermined bandwidth of operation, which is connectable e.g. to the analog front-end circuitry of a wireless RF transceiver. Said monopole antenna can be operated in the frequency range between 3.1 and 10.6 GHz. It comprises e.g. an air- and/or dielectric-filled cavity structure with a base plane and a radiator plane serving as a radiation element, which provides a symmetrical omni-directional radiation pattern, a metallic ground plane serving as a reflector with a relatively high surface impedance to electromagnetic waves within a limited frequency range, printed on a dielectric substrate, an antenna feeding circuitry used for electronically steering the symmetrical omni-directional radiation pattern, and a feeding line connecting the antenna feeding circuitry with the base plane of the radiation element. According to the invention, parts of the analog front-end circuitry can optionally be placed within the radiation element of the ultra-wideband monopole antenna.

The proposed designs include a radiation element having the form of a truncated right circular cone, rotational-symmetric radiation elements with a convexly- or concavely-shaped 3D surface, respectively, a radiation element in the form of a truncated right regular pyramid with a square base plane, and radiation elements with a combined structure comprising a conical, pyramidal, convexly- or concavely-shaped first part as well as a closed cylindrical or cuboidal second part whose top plane is arranged above the congruent base plane of the first part. Further designs include radiation elements in the form of a radially notched cylinder or hemisphere and combined structures consisting of convexly-shaped or conical parts, respectively, stacked on top of each other. The monopole antenna has an overall size of less than 1 $cm^3$, which makes it easy to be integrated in any wireless communication device.

BRIEF DESCRIPTION OF THE DRAWINGS

Further advantages and possible applications of the underlying invention result from the subordinate claims as well as from the following description of different embodiments of the invention as depicted in the following drawings. Herein, FIG. 2*a* is a schematic diagram showing the radiation element, its pedestal, and the RF connector of the ultra-wideband monopole antenna, attached to a dielectric substrate onto which a metallic ground plane is printed, FIG. 2*b* is a schematic diagram based on FIG. 2*a*, which shows a block diagram of a part of the analog front-end circuitry placed within the radiation element of the ultra-wideband monopole antenna.

DETAILED DESCRIPTION OF THE UNDERLYING INVENTION

Figure 1:
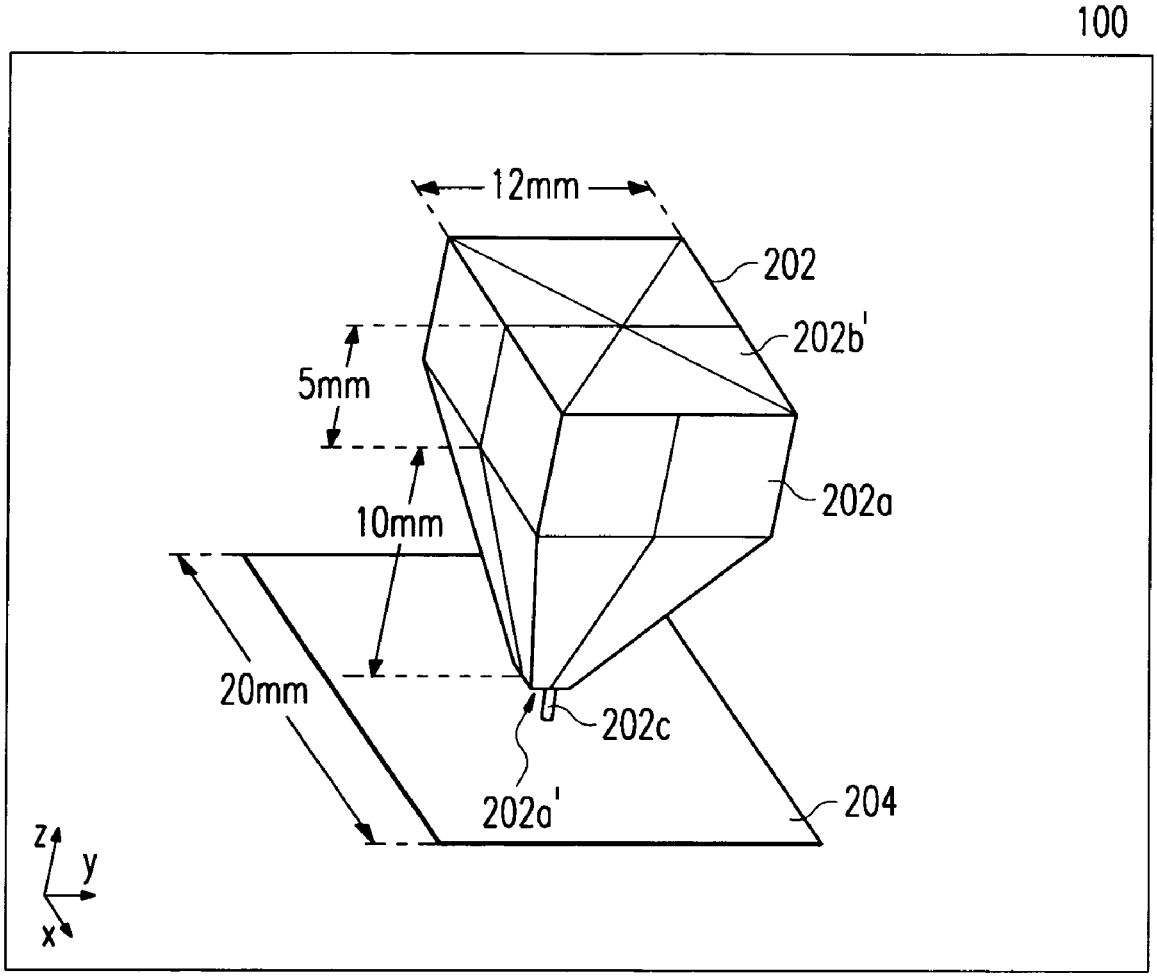
FIG. 1 shows a 3D surface plot of an ultra-wideband monopole antenna with a symmetrical omni-directional radiation pattern for transmitting and/or receiving microwave signals within a predetermined bandwidth of operation, attached to the analog front-end circuitry of a wireless communication device.

In the following, different embodiments of the underlying invention as depicted in FIGS. 1 to 3*l* shall be explained in detail. The meaning of the symbols designated with reference numerals in FIGS. 1 to 3*l* can be taken from an annexed table.

Figure 2C:
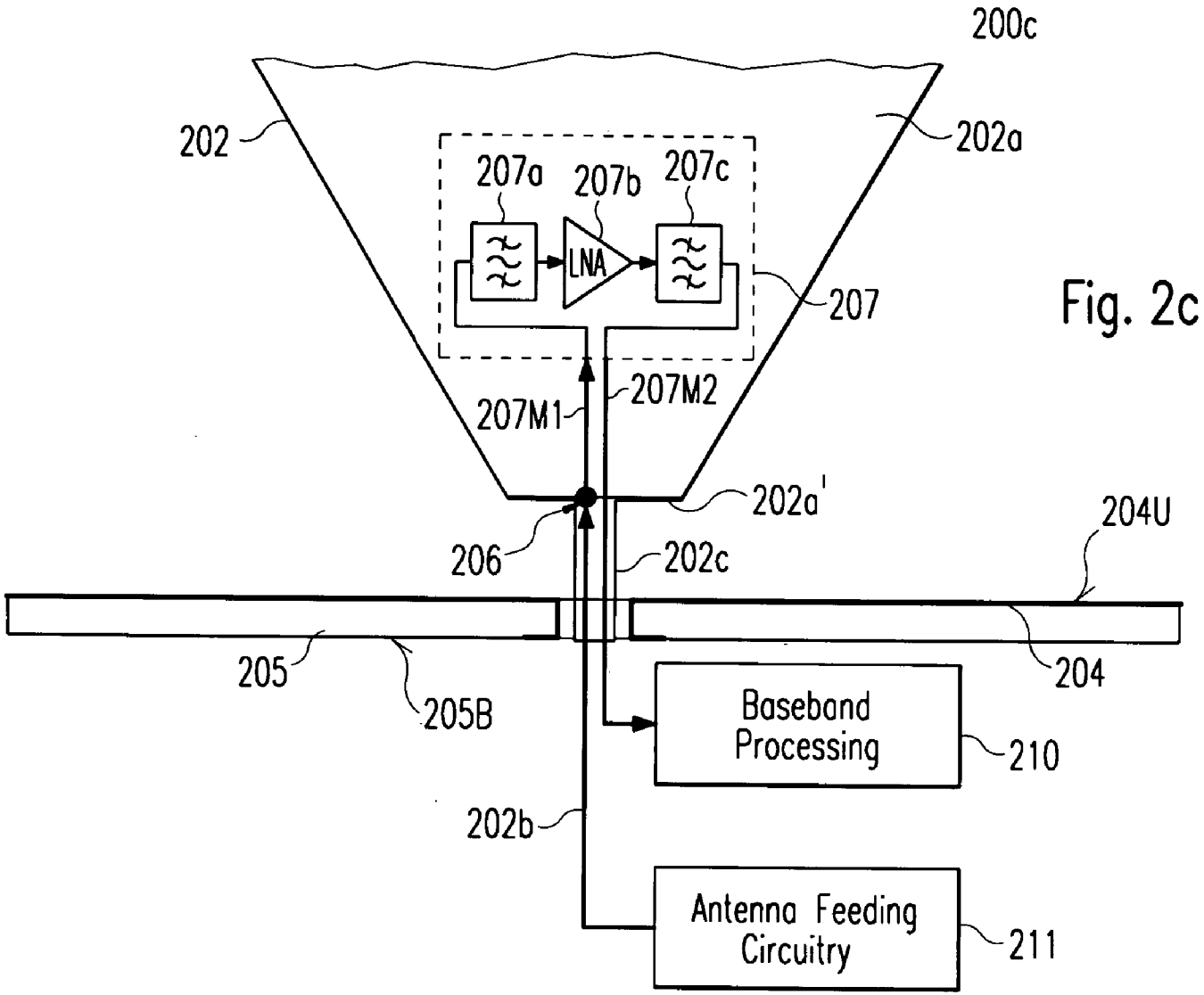
FIG. 2*c* is a schematic diagram based on FIG. 2*c*, which shows the baseband processing block of the ultra-wideband monopole antenna and a feeding circuitry, which is used for electronically steering the symmetrical omni-directional radiation pattern.

FIGS. 2*a-c* show the radiation element 202, which is made of copper, aluminum or any metallic components. The radiation element 202 can also be made of wood or plastic covered by a metallic print, its pedestal 202*c*, and the RF connector 206 of the ultra-wideband monopole antenna 100. Said pedestal 202*c* is attached to a dielectric substrate 205 onto which a metallic ground plane 204 is printed. The RF connector 206 is used for connecting the radiation element 202 with a baseband processing block 210 (in receive case) used for down-converting received microwave signals from the RF band to the baseband or with an antenna feeding circuitry 211 (in transmit case) used for electronically steering the symmetrical omni-directional radiation pattern. Advantageously, the feeding line 202*b* connecting the antenna feeding circuitry 211 with the base plane 202*a*' of the radiation element 202 is realized as a coaxial cable or as a microstrip line. Hence, any special mounting pins are not needed.

According to a further embodiment of the present invention, the monopole antenna 100 has an unbalanced RF input port, e.g. as disclosed in U.S. 2002/0053994 A1, which provides more flexibility in the implementation of consumer electronic equipment. Moreover, an unbalanced input port is more flexible when connecting the antenna to an RF module via coaxial cable. It further allows a direct connection of the metallic ground plane 204 to the ground of the antenna feeding circuitry 211 and can be used for measurement purposes in which a conventional network analyzer is sufficient, whereas in case of a balanced RF input port a differential-to-single-ended converter (a balun) is required.

As depicted in FIGS. 2*b* and 2*c*, at least one part 207 of the analog front-end circuitry placed within the air-filled part of the radiation element 202 of the ultra-wideband monopole antenna 100 comprises band-select filtering means 207*a* for attenuating spurious out-of-band components contained in the RF signal spectrum of a received microwave signal, amplification means 207*b* for controlling the input power level of the wireless communication device and band-pass filtering means 207*c* for suppressing out-of-band frequencies in the received RF signal spectrum.

According to one embodiment of the present invention, the ultra-wideband monopole antenna is a part of an antenna terminal which is specially designed for being operated in the frequency range between 3.1 and 10.6 GHz. Said antenna provides a symmetrical omni-directional radiation pattern in azimuth plane with 90 degrees in elevation over the entire frequency range. The radiation beam thereby exhibits a linear vertical polarization, linear phase variation $\Delta\phi$ versus frequency $\omega$, which means a constant group delay $$\tau_g(\omega) = \frac{d\varphi(\omega)}{d\omega} = : \tau_{g0} \text{ with } \tau_{g0} = const. \tag{1}$$

over the entire frequency range, as well as a flat amplitude response (around 3 dB) over the entire frequency range. Without using a resistive load, the return loss $$RL := -20 \cdot \log_{10}|\rho|[\text{dB}], \tag{2a}$$

which is defined over the magnitude of the complex-valued reflection coefficient $\rho$ as the ratio (in dB) of the power incident on the antenna terminal to the power reflected from the antenna terminal, has a value of less than −10 dB in a frequency range between 3.1 GHz and 10.6 GHz, which corresponds to a voltage standing wave ratio $$VSWR = \frac{1 + |\rho|}{1 - |\rho|} \tag{2b}$$

of less than 2. In case a resistive load and/or additional impedance matching circuitries are used, a return loss even better than −10 dB can be achieved.

In the following, different designs of the ultra-wideband monopole antenna 100 according to twelve embodiments 300*a-l* of the present invention as depicted in FIGS. 3*a-l* shall be explained in detail.

Figure 3B:
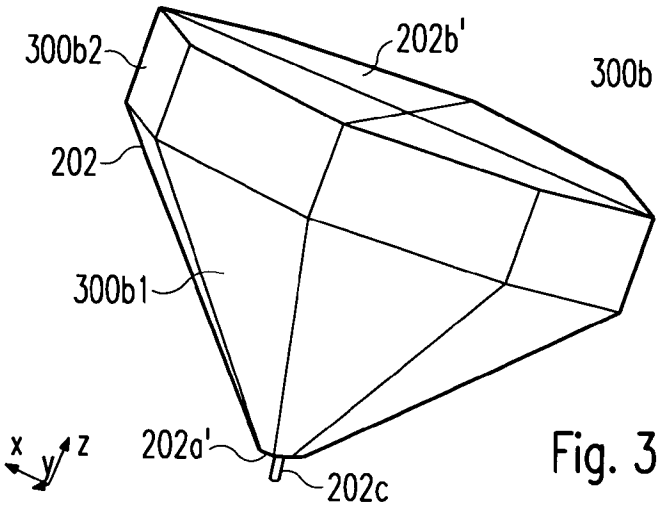
FIGS. 3*a-l* show twelve 3D surface plots exhibiting different designs of the monopole antenna according to twelve embodiments of the present invention.
Figure 3A:
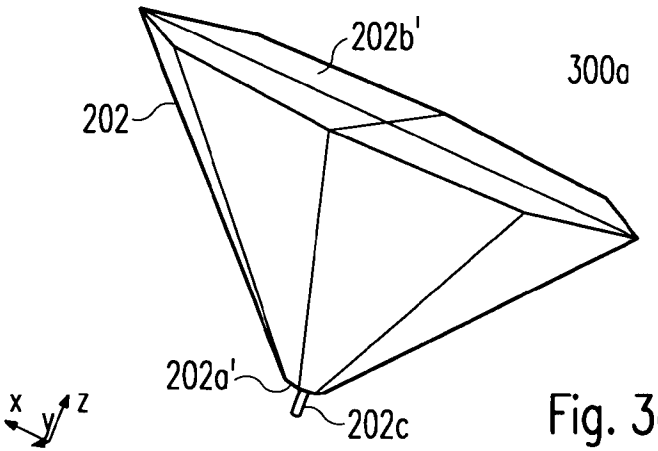

FIG. 3*a* depicts a first 3D surface plot showing a first design for the radiation element 202 of the monopole antenna 100 according to a first embodiment 300*a* of the present invention, wherein the radiation element 202 has a rotational-symmetric form with a circular cross section and a conical structure.

The second 3D surface plot depicted in FIG. 3*b*, which shows a second design for the radiation element 202 of the monopole antenna 100 according to a second embodiment 300*b* of the present invention, comprises a first part 300*b*1 having a rotational-symmetric form with a circular cross section, a conical structure and a second part 300*b*2 having the form of a closed right circular cylinder with a circular top plane congruent to the circular base plane of the conical first part 300*b*1. Thereby, the circular top plane of the cylindrical second part 300*b*2 is coaxially arranged above the circular base plane of the conical first part 300*b*1.

Figure 3D:
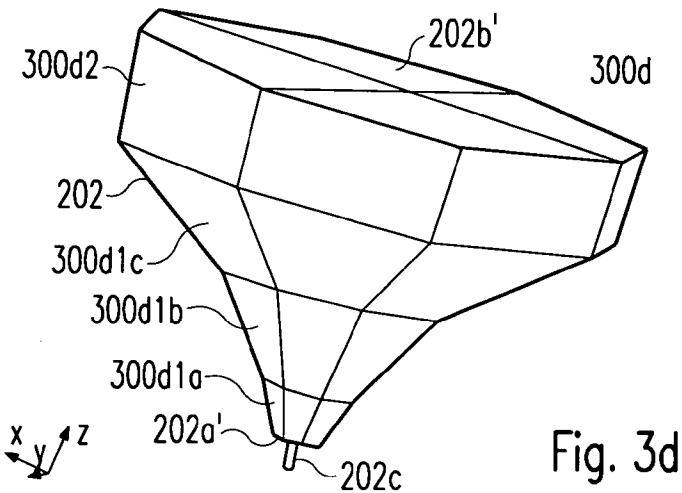
Figure 3C:
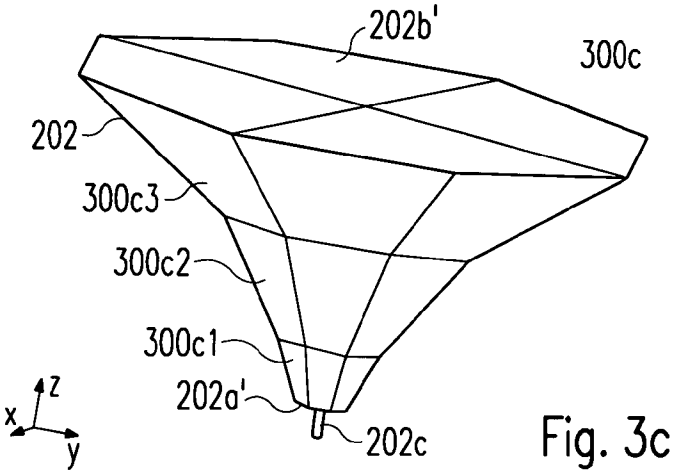

FIG. 3*c* depicts a third 3D surface plot showing a third design for the radiation element 202 of the monopole antenna 100 according to a third embodiment 300*c* of the present invention, wherein the radiation element 202 has a rotational-symmetric form with a circular cross section, a conical structure and a concave 3D surface.

The fourth 3D surface plot depicted in FIG. 3*d*, which shows a fourth design for the radiation element 202 of the monopole antenna 100 according to a fourth embodiment 300*d* of the present invention, comprises a first part 300*d*1 having a rotational-symmetric form with a circular cross section, a conical structure, a concave 3D surface and a second part 300*d*2 having the form of a closed right circular cylinder with a circular top plane congruent to the circular base plane of the conical first part 300*d*1, wherein the circular top plane of the cylindrical second part 300*d*2 is coaxially arranged above the circular base plane of the concavely-shaped first part 300*d*1.

Figure 3F:
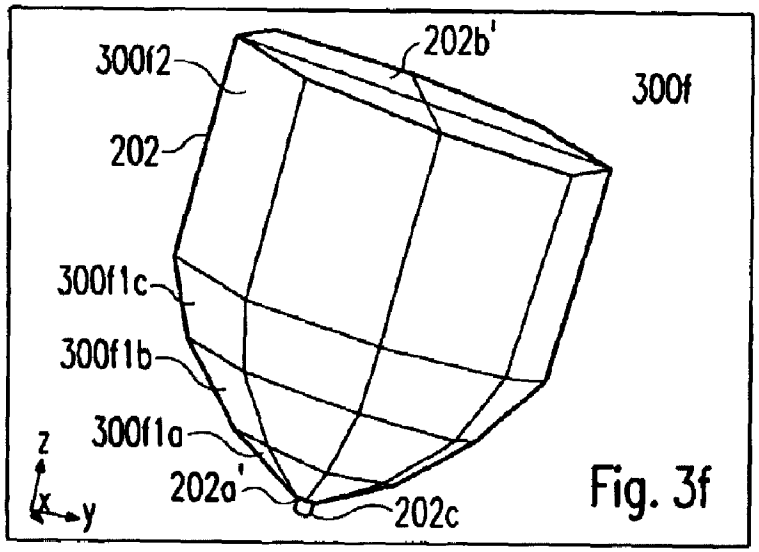
Figure 3H:
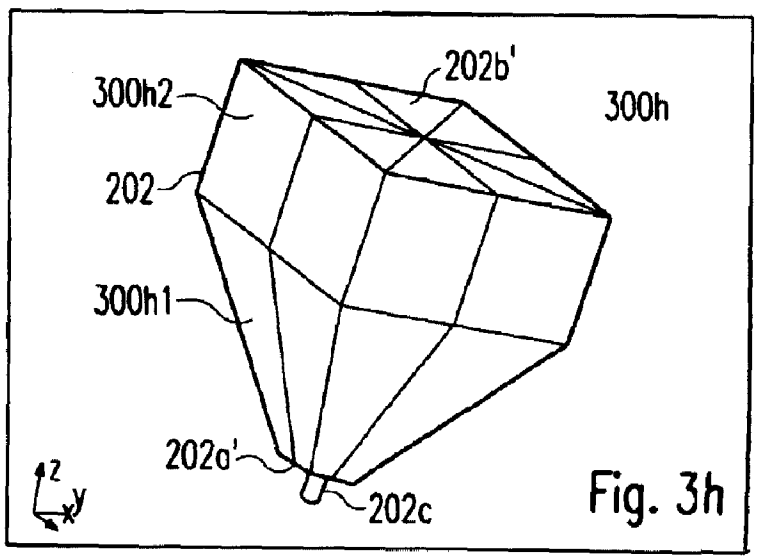
Figure 3E:
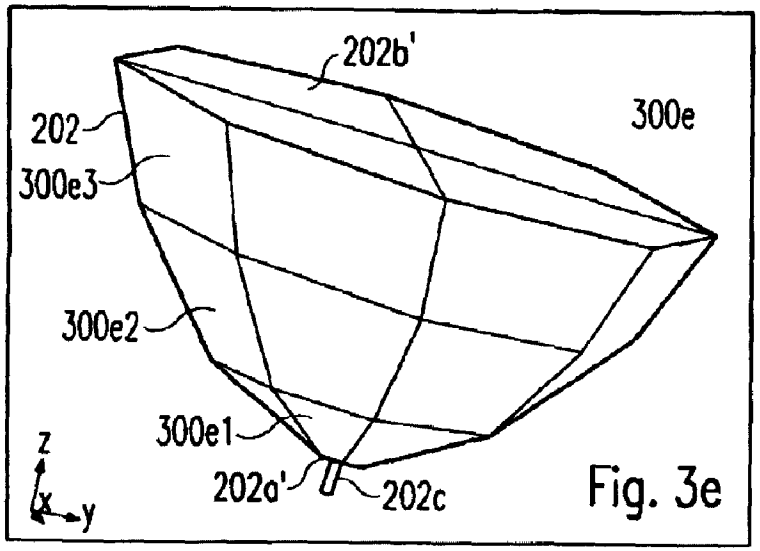

FIG. 3*e* depicts a fifth 3D surface plot showing a fifth design for the radiation element 202 of the monopole antenna 100 according to a fifth embodiment 300*e* of the present invention, wherein the radiation element 202 has a rotational-symmetric form with a circular cross section, a conical structure and a convex 3D surface.

The sixth 3D surface plot depicted in FIG. 3*f*, which shows a sixth design for the radiation element 202 of the monopole antenna 100 according to a sixth embodiment 300*f* of the present invention, comprises a first part 300*f*1 having a rotational-symmetric form with a circular cross section, a conical structure, a convex 3D surface and a second part 300*f*2 having the form of a closed right circular cylinder with a circular top plane congruent to the circular base plane of the conical first part 300*f*1, wherein the top plane of the cylindrical second part 300*f*2 is coaxially arranged above the base plane of the convexly-shaped first part 300*f*1.

Figure 3G:
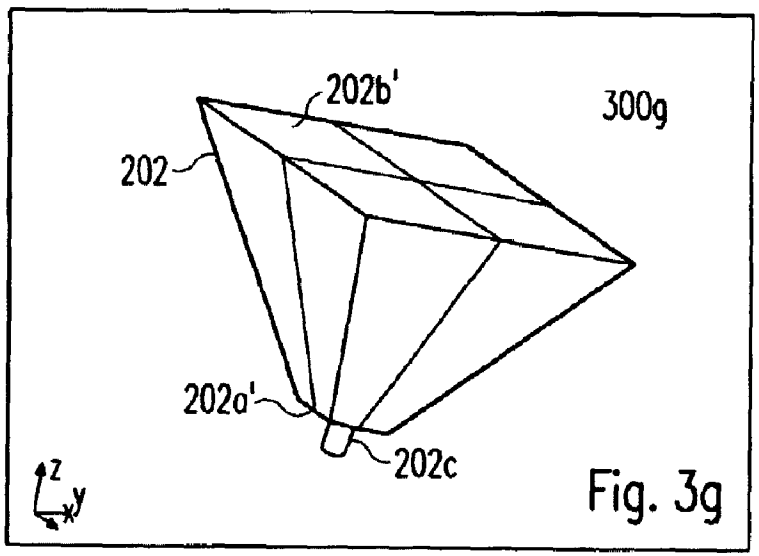

FIG. 3*g* depicts a seventh 3D surface plot showing a seventh design for the radiation element 202 of the monopole antenna 100 according to a seventh embodiment 300*g* of the present invention, wherein the radiation element 202 has the form of a truncated right regular pyramid with a square base plane.

The eighth 3D surface plot depicted in FIG. 3*h*, which shows an eighth design for the radiation element 202 of the monopole antenna 100 according to an eighth embodiment 300*h* of the present invention, comprises a first part 300*h*1 in form of a truncated right square pyramid and a second part 300*h*2 having the form of a closed right rectangular parallelepiped (a cuboid) with a square top plane congruent to the square base plane of the pyramidal first part 300*h*1, wherein the square top plane of the cuboidal second part 300*h*2 is placed above the congruent square base plane of the pyramidal first part 300*h*1.

Figure 3J:
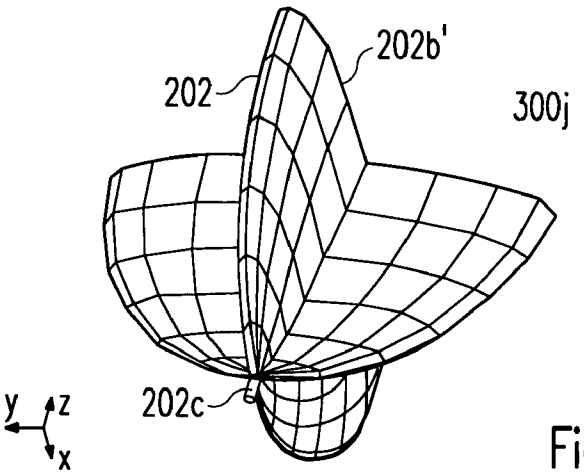
Figure 3L:
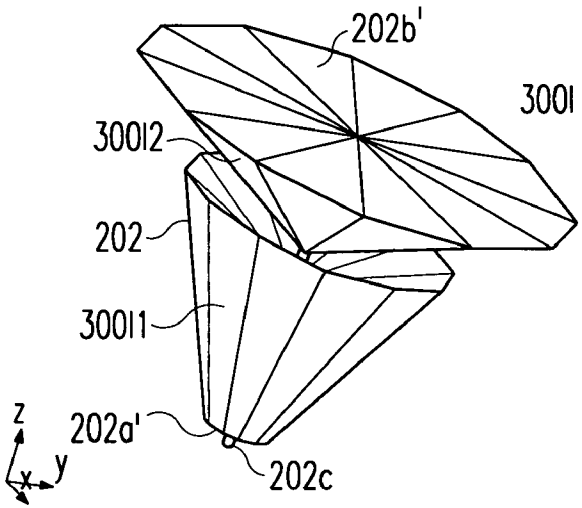
Figure 3I:
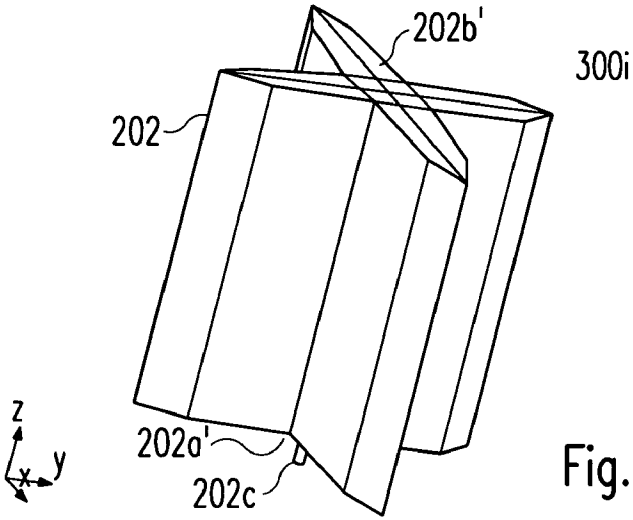

FIG. 3*i* depicts a ninth 3D surface plot showing a ninth design for the radiation element 202 of the monopole antenna 100 according to a ninth embodiment 300*i* of the present invention, wherein the radiation element 202 has the form of a right circular cylinder with four V-shaped radial notches running in longitudinal direction, equally spaced in azimuthal direction around the circumference of the cylinder, which leads to a cross section in the form of two perpendicular elliptical stripes.

Analogously, FIG. 3*j* depicts a tenth 3D surface plot showing a tenth design for the radiation element 202 of the monopole antenna 100 according to a tenth embodiment 300*j* of the present invention, wherein the radiation element 202 has the form of a hemisphere with four V-shaped radial notches running in longitudinal direction, equally spaced in azimuth around the circumference of the hemisphere, which leads to a cross section in the form of two perpendicular elliptical stripes.

Figure 3K:
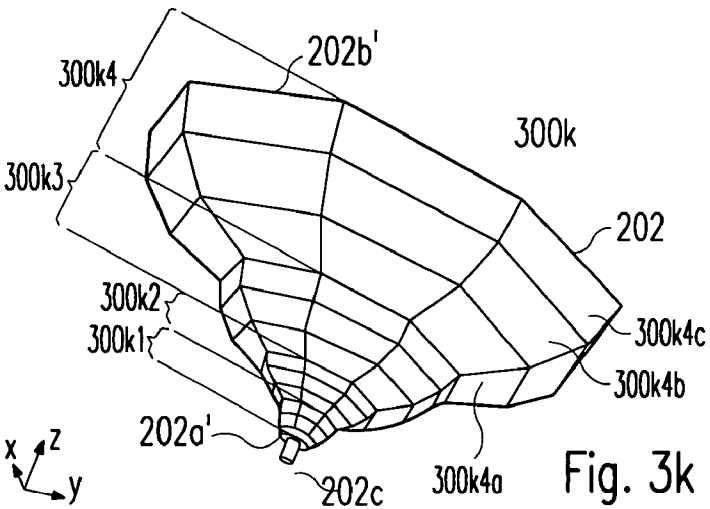

The eleventh 3D surface plot depicted in FIG. 3*k*, which shows an eleventh design for the radiation element 202 of the monopole antenna 100 according to an eleventh embodiment 300*k* of the present invention, comprises at least two parts of same or different height, each part having a rotational-symmetric form with a circular cross section, a conical structure as well as a convex 3D surface. FIG. 3*k* shows an example in which only four parts are used (300*k*1, 300*k*2, 300*k*3, 300*k*4), wherein each of the parts 300*k*2, 300*k*3, and 300*k*4 has a circular top plane which is congruent to the circular base plane of the parts 300*k*1, 300*k*2, and 300*k*3, respectively. Said parts 300*k*1, 300*k*2, 300*k*3, and 300*k*4 are stacked on top of each other in the order of the length of their radii. The circular top planes of the parts 300*k*2, 300*k*3, and 300*k*4 are coaxially arranged on top of the congruent circular base planes of the adjacent next smaller parts 300*k*1, 300*k*2, and 300*k*3, respectively.

The twelfth 3D surface plot depicted in FIG. 31, which shows a twelfth design for the radiation element 202 of the monopole antenna 100 according to a twelfth embodiment 300*l* of the present invention, comprises a first part 300*l*1 having the form of a truncated right circular cone and a second part having the form of a closed right circular cone with a smaller height and a bigger aperture angle, wherein the cone top of the second part 300*l*2 is coaxially arranged above the center of the circular base plane of the first part 300*l*1.

Within the cavity resonator 202*a* of the radiation element 202, transversal electromagnetic mode (TEM) waves exist together with higher-order modes created at the base plane 202*a*' of the radiation element 202. These higher-order modes are the major contribution to the reactive part X(O) of the antenna input impedance $Z(\omega)=R(\omega)+j\cdot X(\omega)$. Reflections of the electromagnetic waves at the base plane 202*a*' and standing waves thereby lead to a complex-valued antenna input impedance $Z(\omega)$ with a reactive part $X(\omega)\neq 0$. It can be shown that $X(\omega)$ depends on the length of the radiation element and $X(\omega)=0$ can only be achieved for a biconical radiation element 202 with infinite length. By increasing the aperture angle of the radiation element 202, the reactance $X(\omega)$ can be hold to a minimum over a wide frequency range. At the same time, the resistive part $R(\omega)$ of the antenna input impedance $Z(\omega)$ becomes less sensitive to changing angular frequency w or changes in the length.

A still further embodiment of the present invention refers to an RF transceiver of a wireless communications device, wherein a monopole antenna 100 as described above is employed. Furthermore, a further monopole antenna 100' of the same type as described above can be symmetrically attached to the rear side of the metallic ground plane 204 with respect to the existing monopole antenna 100, thus forming a dipole antenna dimensioned for the Ultra-Wideband frequency range.

Finally, the invention refers to an electronic device having a wireless interface which comprises an RF transceiver as described above.

TABLE

Depicted Features and their Corresponding Reference Signs

| No. | System Component, Technical Feature |
|---|---|
| 100 | 3D surface plot of an ultra-wideband monopole Tx/Rx antenna with an symmetrical omni-directional radiation pattern for transmitting and/or receiving microwave signals within a predetermined bandwidth of operation, attached to the analog front-end circuitry of a wireless communication device (cf. FIG. 3h) |
| 100' | second Tx/Rx monopole antenna of the same type (not shown), with respect to the existing monopole antenna 100 symmetrically attached to the rear side of the metallic ground plane 204, thus forming a dipole antenna dimensioned for the Ultra-Wideband frequency range |
| 200a | schematic diagram showing the radiation element 202, its pedestal 202c, and the RF connector 206 of the ultra-wideband monopole Tx/Rx antenna 100, attached to a dielectric substrate 205 onto which a metallic ground plane 204 is printed |
| 200b | schematic diagram according to FIG. 2a, additionally showing a block diagram of a part of the analog front-end circuitry being placed within the radiation element 202 of the ultra-wideband monopole Tx/Rx antenna 100, said part comprising band-select filtering means 207a, amplification means 207b and image-reject filtering means 207c |
| 200c | schematic diagram according to FIG. 2c, additionally showing the baseband processing block 210 of the ultra-wideband monopole Tx/Rx antenna 100, which is used for up-converting baseband signals to be transmitted from the baseband to an RF band and down-converting received microwave signals from the RF band to the baseband, respectively, and the antenna feeding circuitry 211 of the ultra-wideband monopole Tx/Rx antenna 100, which is used for electronically steering the radiation beam of the symmetrical omni-directional radiation pattern |
| 202 | radiation element of the ultra-wideband monopole Tx/Rx antenna 100 |
| 202a | air- and/or dielectric-filled cavity resonator with a conductive surface, which serves as a radiation element 202 |
| 202a' | base plane of the radiation element 202, made of a conducting material, which is connected with the baseband processing block 210 (in receive case) or the antenna feeding circuitry 211 (in transmit case), respectively |
| 202b' | radiator plane of the radiation element 202, made of a conducting material |
| 202b | feeding line connecting the antenna feeding circuitry 211 with the base plane 202a' of the radiation element 202, realized as a coaxial cable or microstrip line |
| 202c | pedestal of the radiation element 202, fix attached to the dielectric substrate 205 |
| 204 | metallic ground plane serving as a reflector with a relatively high surface impedance to electromagnetic waves within a limited frequency band, printed on a (dielectric) substrate 205 |
| 204U | upper side of the metallic ground plane 204 |
| 205 | dielectric substrate of the ultra-wideband monopole Tx/Rx antenna 100 onto which the metallic ground plane 204 is printed |
| 205B | bottom side of the dielectric substrate 205 |
| 206 | RF connector of the ultra-wideband monopole Tx/Rx antenna 100, used for connecting the radiation element 202 with the baseband processing block 210 (in receive case) or the antenna feeding circuitry 211 (in transmit case), respectively |
| 207 | part of the analog front-end circuitry which is placed within the radiation element 202 of the ultra-wideband monopole Tx/Rx antenna 100, said part comprising band-select filtering means 207a, amplification means 207b and image-reject filtering means 207c |
| 207a | band-select filter of the analog front end for attenuating spurious out-of-band components contained in the signal spectrum of a received microwave signal, placed within the radiation element 202 |
| 207b | low-noise amplifier (LNA) of the analog front end for controlling the output power level of the wireless communication device, placed within the radiation element 202 |
| 207c | image-reject filter of the analog front end for suppressing image frequencies in an obtained microwave signal spectrum, placed within the radiation element 202 |
| 207M1 | first microstrip line, which connects the base plane 202a' with the antenna feeding circuitry 211 |
| 207M2 | second microstrip line, which connects the part 207 of the analog front-end circuitry placed within the radiation element 202 with the baseband processing block 210 |
| 210 | baseband processing block of the ultra-wideband monopole Tx/Rx antenna 100 for up-converting baseband signals to be transmitted from the baseband to an RF band and down-converting received microwave signals from the RF band to the baseband, respectively |
| 211 | antenna feeding circuitry of the ultra-wideband monopole Tx/Rx antenna 100, used for electronically steering the radiation beam of the symmetrical omni-directional radiation pattern |
| 300a | first 3D surface plot showing a first design of the monopole antenna 100 according to a first embodiment of the present invention, wherein the radiation element 202 has a rotational-symmetric form with a circular cross section and a conical structure (for simplification of the graphical representation sketched in form of a truncated right regular pyramid with an octagonal base plane 202a' as well as an octagonal radiation plane 202b') |
| 300b | second 3D surface plot showing a second design of the monopole antenna 100 according to a second embodiment of the present invention, wherein the radiation element 202 comprises a first part 300b1 having a rotational-symmetric form with a circular cross section and a conical structure (cf. FIG. 3a) as well as a second part 300b2 having the form of a closed right circular cylinder with a circular top plane congruent to the circular base plane of the conical first part 300b1, wherein the circular top plane of the |

TABLE-continued

Depicted Features and their Corresponding Reference Signs

| No. | System Component, Technical Feature |
|---|---|
| | cylindrical second part 300b2 is coaxially arranged above the circular base plane of the conical first part 300b1 (approximated by a 3D surface plot showing a truncated right regular octagonal pyramid 300b1 with a right regular octagonal prism 300b2 whose top plane is arranged above the congruent base plane of the truncated right regular octagonal pyramid 300b1) |
| 300b1 | first part of the second 3D surface plot structure 300b, having a rotational-symmetric form with a circular cross section and a conical structure (cf. FIG. 3a) |
| 300b2 | second part of the second 3D surface plot structure 300b with the form of a right circular cylinder, coaxially arranged above the congruent base plane of the first part 300b1 |
| 300c | third 3D surface plot showing a third design of the monopole antenna 100 according to a third embodiment of the present invention, wherein the radiation element 202 has a rotational-symmetric form with a circular cross section, a conical structure and a concave surface (for simplification of the graphical representation sketched in form of three truncated right regular octagonal pyramids 300c1, 300c2, and 300c3) |
| 300d | fourth 3D surface plot showing a fourth design of the monopole antenna 100 according to a fourth embodiment of the present invention, wherein the radiation element 202 comprises a first part 300d1 having a rotational-symmetric form with a circular cross section, a conical structure and a concave surface (cf. FIG. 3c) as well as a second part 300d2 having the form of a closed right circular cylinder with a circular top plane congruent to the circular base plane of the conical first part 300d1, wherein the circular top plane of the cylindrical second part 300d2 is coaxially arranged above the circular base plane of the concavely-shaped first part 300d1 (approximated by a 3D surface plot showing three truncated right regular octagonal pyramids 300d1a–c with a right regular octagonal prism 300d2 whose top plane is arranged above the congruent base plane of the biggest pyramid 300d1c) |
| 300d1 | first part of the fourth 3D surface plot structure 300d, having a rotational-symmetric form with a circular cross section, a conical structure and a concave surface (cf. FIG. 3c) |
| 300d2 | second part of the fourth 3D surface plot structure 300d with a cylindrical form, coaxially arranged above the congruent base plane of the first part 300d1 |
| 300e | fifth 3D surface plot showing a fifth design of the monopole antenna 100 according to a fifth embodiment of the present invention, wherein the radiation element 202 has a rotational-symmetric form with a circular cross section, a conical structure and a convex surface (for simplification of the graphical representation sketched in form of three truncated right regular octagonal pyramids 300e1, 300e2, and 300e3) |
| 300f | sixth 3D surface plot showing a sixth design of the monopole antenna 100 according to a sixth embodiment of the present invention, wherein the radiation element 202 comprises a first part 300f1 having a rotational-symmetric form with a circular cross section, a conical structure and a convex surface (cf. FIG. 3e) as well as a second part 300f2 having the form of a closed right circular cylinder with a circular top plane congruent to the circular base plane of the conical first part 300f1, wherein the top plane of the cylindrical second part 300f2 is coaxially arranged above the base plane of the convexly-shaped first part 300f1 (approximated by a 3D surface plot showing three truncated right regular octagonal pyramids 300fla–c with a right regular octagonal prism whose top plane is arranged above the congruent base plane of the biggest pyramid 300f1c) |
| 300f1 | first part of the sixth 3D surface plot structure 300f, having a rotational-symmetric form with a circular cross section, a conical structure and a convex surface (cf. FIG. 3e) |
| 300f2 | second part of the sixth 3D surface plot structure 300f with a cylindrical form, coaxially arranged above the congruent base plane of the first part 300f1 |
| 300g | seventh 3D surface plot showing a seventh design of the monopole antenna 100 according to a seventh embodiment of the present invention, wherein the radiation element 202 has the form of a truncated right regular pyramid with a square base plane |
| 300h | eighth 3D surface plot showing an eighth design of the monopole antenna 100 according to an eighth embodiment of the present invention, wherein the radiation element 202 comprises a first part 300h1 in form of a truncated right square pyramid (cf. FIG. 3g) as well as a second part 300h2 having the form of a closed right rectangular parallelepiped (a cuboid) with a square top plane congruent to the square base plane of the pyramidal first part 300h1, wherein the square top plane of the cuboidal second part 300h2 is arranged above the congruent base plane of said first part 300h1 |
| 300h1 | first part of the eighth 3D surface plot structure 300h, having the form of a truncated right square pyramid (cf. FIG. 3g) |
| 300h2 | second part of the eighth 3D surface plot structure 300h, having the form of a right rectangular parallelepiped (cuboid) with a square base plane 202a' arranged above the congruent base plane of the first part 300h1 |
| 300i | ninth 3D surface plot showing a ninth design of the monopole antenna 100 according to a ninth embodiment of the present invention, wherein the radiation element 202 has the form of a right circular cylinder with four V-shaped radial notches running in longitudinal direction, equally spaced in azimuth around the circumference of the cylinder, which leads to a cross section in the form of two perpendicularly crossing stripes, each stripe having a radially tapered thickness and rounded ends |
| 300j | tenth 3D surface plot showing a tenth design of the monopole antenna 100 according to a tenth embodiment of the present invention, wherein the radiation element 202 has the form of a hemisphere with four V-shaped radial notches running in longitudinal direction, equally spaced in azimuth around the circumference of the hemisphere, which |

TABLE-continued

| Depicted Features and their Corresponding Reference Signs | |
|---|---|
| No. | System Component, Technical Feature |
| | leads to a cross section in the form of two perpendicularly crossing stripes, each stripe having a radially tapered thickness and rounded ends |
| 300k | eleventh 3D surface plot showing an eleventh design of the monopole antenna 100 according to an eleventh embodiment of the present invention, wherein the radiation element 202 comprises four parts 300k1, 300k2, 300k3, and 300k4 of different size, each having a rotational-symmetric form with a circular cross section, a conical structure and a convex surface, wherein each of the parts 300k2, 300k3, and 300k4 has a circular top plane congruent to the circular base plane of the parts 300k1, 300k2, and 300k3, respectively, said parts 300k1, 300k2, 300k3, and 300k4 being stacked on top of each other in the order of the length of their radii, wherein the circular top planes of the parts 300k2, 300k3, and 300k4 are coaxially arranged above the congruent circular base planes of the adjacent next smaller parts 300k1, 300k2, and 300k3, respectively (approximated by a 3D surface plot showing four octagonal parts 300k1, 300k2, 300k3, and 300k4 stacked on top of each other in the order of their base plane size, each part consisting of three truncated right regular octagonal pyramids 300kna, 300knb, and 300knc (for $n \in \{1, 2, 3, 4\}$) stacked on top of each other in the order of their base plane size) |
| 300k1 | first (smallest) part of the monopole antenna 100 according to an eleventh embodiment 300k of the present invention, having a rotational-symmetric form with a circular cross section, a conical structure and a convex surface |
| 300k2 | second part of the monopole antenna 100 according to an eleventh embodiment 300k of the present invention, having a rotational-symmetric form with a circular cross section, a conical structure and a convex surface |
| 300k3 | third part of the monopole antenna 100 according to an eleventh embodiment 300k of the present invention, having a rotational-symmetric form with a circular cross section, a conical structure and a convex surface |
| 300k4 | fourth (biggest) part of the monopole antenna 100 according to an eleventh embodiment 300k of the present invention, having a rotational-symmetric form with a circular cross section, a conical structure and a convex surface |
| 300l | twelfth 3D surface plot showing a twelfth design of the monopole antenna 100 according to a twelfth embodiment of the present invention, wherein the radiation element 202 comprises a first part 300l1 having the form of a truncated right circular cone as well as a second part having the form of a closed right circular cone with a smaller height and a bigger aperture angle, wherein the cone top of the second part 300l2 is coaxially arranged above the center of the circular base plane of the first part 300l1 (approximated by a 3D surface plot showing a first part 300l1 having the form of a truncated right regular dodecagonal pyramid and a second part 300l2 having the form of a right regular dodecagonal pyramid with a smaller height and a smaller pyramid slope angle, wherein the pyramid top of the second part 300l2 is arranged above the center of the base plane of the first part 300l1) |
| 300l1 | first part of the monopole antenna 100 according to a twelfth embodiment of the present invention, having the form of a truncated right circular cone |
| 300l2 | second part of the monopole antenna 100 according to a twelfth embodiment of the present invention with the form of a right circular cone, coaxially arranged above the center of the circular base plane of the first part 300l1 |

The invention claimed is:

1. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane located outside of the three-dimensional cavity structure and opposite to said base plane, an antenna feeding circuitry, and a feeding line connecting the antenna feeding circuitry with the base plane of the radiation element, wherein at least parts of the analog front-end circuitry are placed within the radiation element of the ultra-wide-band monopole antenna.

2. A monopole antenna according to claim 1, wherein the analog front-end circuitry placed within the radiation element includes at least one of band-select filtering means, amplification means and band pass filtering means.

3. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element includes a first part having a rotational-symmetric form with a circular cross section, a conical structure and a second part having a form of a closed right circular cylinder with a circular top plane congruent to circular base plane of the conical first part, wherein the circular top plane of the cylindrical second part is coaxially arranged above the congruent circular base plane of said first part.

4. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element has a rotational-symmetric form with a circular cross section, a conical structure and a concave 3D surface.

5. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element includes a first part having a rotational-symmetric form with a circular cross section, a conical structure, a concave 3D surface and a second part having a form of a closed right circular cylinder with a circular top plane congruent to a circular base plane of the conical first part, wherein the circular top plane of the cylindrical second part is coaxially arranged above the congruent circular base plane of the concavely-shaped first part.

6. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element has a rotational-symmetric form with a circular cross section, a conical structure and a convex 3D surface.

7. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element includes a first part having a rotational-symmetric form with a circular cross section, a conical structure, a convex 3D surface and a second part having a form of a closed right circular cylinder with a circular top plane congruent to a circular base plane of the conical first part, wherein the top plane of the cylindrical second part is coaxially arranged above the congruent circular base plane of the convexly-shaped first part.

8. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element includes a first part in form of a truncated right square pyramid and a second part having a form of a closed right rectangular parallelepiped with a square top plane congruent to a square base plane of the pyramidal first part, wherein the square top plane of the cuboidal second part is arranged above the congruent square base plane of the pyramidal first part.

9. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element has form of a right circular cylinder with four V-shaped radial notches running in longitudinal direction, equally spaced in azimuth around the circumference of the cylinder, which leads to a cross section in a second form of two perpendicular crossing elliptical structure.

10. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element has a form of a hemisphere with four V-shaped radial notches running in longitudinal direction, equally spaced in azimuth around the circumference of the hemisphere, which leads to a cross section in a second form of two perpendicularly crossing elliptical structure.

11. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element includes at least two parts of the same or different height, each having a rotational-symmetric form with a circular cross section, a conical structure and a convex 3D surface, wherein each part of a first group of said parts has a circular top plane congruent to a circular base plane of a part of a second group of said parts, respectively, said parts being stacked on top of each other in an order of a length of their radii, wherein the circular top planes of the parts from said first group are coaxially arranged above the congruent circular base planes of the adjacent next smaller parts from said second group, respectively.

12. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, wherein the radiation element includes a first part having a form of a truncated right circular cone with a circular base plane and a second part having a second form of a closed right circular cone with a smaller height and a bigger aperture angle, wherein the cone top of the second part is coaxially attached to the center of the circular base plane of the first part.

13. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane located outside of the three-dimensional cavity structure and opposite to said base plane, an antenna feeding circuitry, and a feeding line connecting the antenna feeding circuitry with the base plane of the radiation element, wherein the feeding line connecting the antenna feeding circuitry with the base plane of the radiation element is realized as a coaxial cable.

14. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, the feeding line connecting the antenna feeding circuitry with the base plane of the radiation element is realized as a microstrip line, wherein the radiation beam exhibits a flat amplitude response around 3 dB over the entire frequency range.

15. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, the feeding line connecting the antenna feeding circuitry with the base plane of the radiation element is realized as a microstrip line, and wherein said monopole antenna is configured to provide a symmetrical omni-directional radiation pattern in azimuth plane with 160 degrees in elevation over the entire frequency range.

16. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane located outside of the three-dimensional structure and opposite to said base plane, an antenna feeding circuitry, and a feeding line connecting the antenna feeding circuitry with the base plane of the radiation element, the feeding line connecting the antenna feeding circuitry with the base plane of the radiation element is realized as a microstrip line, wherein said monopole antenna is configured to provide a symmetrical omni-directional radiation pattern that approximately exhibits linear phase variation versus frequency.

17. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, the feeding line connecting the antenna feeding circuitry with the base plane of the radiation element is realized as a microstrip line, and wherein said monopole antenna has a return loss of less than −10 dB in a frequency range between 3.1 and 10.6 GHz, which corresponds to a voltage standing wave ratio of less than 2.

18. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, the feeding line connecting the antenna feeding circuitry with the base plane of the radiation element is realized as a microstrip line, wherein said monopole antenna has a return loss even better than −10 dB in a frequency range between 3.1 and 10.6 GHz when using a resistive load and/or additional impedance matching circuitries.

19. A monopole antenna for microwave signals, attachable to an analog front-end circuitry of a wireless communication device, wherein said antenna is dimensioned for an Ultra-Wideband frequency range and comprises:

a three-dimensional cavity structure with radiating elements with a base plane serving as a radiation element, a metallic ground plane, an antenna feeding circuitry, and a feeding line connecting the antenna feeding circuitry with the base plane of the radiation element, the feeding line connecting the antenna feeding circuitry with the base plane of the radiation element is realized as a microstrip line, wherein the radiation element has an overall size of less than 1 $cm^3$.

20. An RF transceiver or a wireless communications device, comprising:

a monopole antenna for microwave signals, attachable to the analog front-end circuitry of a wireless communication device, wherein said antenna is dimensioned for the Ultra-Wideband frequency range and includes a three-dimensional cavity structure with radiating elements with a base plane serving as a radiation element, a metallic ground plane, an antenna feeding circuitry, a feeding line connecting the antenna feeding circuitry with the base plane of the radiation element, and a further monopole antenna, with respect to the existing monopole antenna symmetrically attached to the rear side of the metallic ground plane, thus forming a dipole antenna dimensioned for the Ultra-Wideband frequency range.

* * * * *